US010267497B2

(12) United States Patent
McCane

(10) Patent No.: US 10,267,497 B2
(45) Date of Patent: Apr. 23, 2019

(54) EASY INSTALL LIGHT ENGINE RETROFIT KIT AND METHOD FOR USING SAME

(71) Applicant: ABL IP Holding LLC, Decatur, GA (US)

(72) Inventor: Stephen Barry McCane, McDonough, GA (US)

(73) Assignee: ABL IP Holding LLC, Atlanta, GA (US)

( * ) Notice: Subject to any disclaimer, the term of this patent is extended or adjusted under 35 U.S.C. 154(b) by 277 days.

(21) Appl. No.: 15/014,518

(22) Filed: Feb. 3, 2016

(65) Prior Publication Data

US 2016/0223144 A1 Aug. 4, 2016

Related U.S. Application Data

(60) Provisional application No. 62/112,017, filed on Feb. 4, 2015.

(51) Int. Cl.

| | |
|---|---|
| ***F21V 19/00*** | (2006.01) |
| ***F21V 21/02*** | (2006.01) |
| *F21V 7/00* | (2006.01) |
| *F21Y 103/00* | (2016.01) |
| *F21Y 115/10* | (2016.01) |

(52) U.S. Cl.

CPC ..... *F21V 19/00* (2013.01); *F21V 21/02* (2013.01); *F21V 7/005* (2013.01); *F21Y 2103/00* (2013.01); *F21Y 2115/10* (2016.08)

(58) Field of Classification Search

CPC .. F21Y 2115/10; F21Y 2103/00; F21V 19/00; F21V 21/02; F21V 7/005

See application file for complete search history.

(56) References Cited

U.S. PATENT DOCUMENTS

| | | | |
|---|---|---|---|
| 2,258,354 | A | 10/1941 | Doane |
| 2,259,151 | A | 10/1941 | Claspy |
| 2,281,379 | A | 4/1942 | Ohm |
| D133,216 | S | 7/1942 | Partato |

(Continued)

OTHER PUBLICATIONS

Office Action for Canadian Application No. CA 2,919,802, dated Mar. 13, 2017, 4 pages.

(Continued)

*Primary Examiner* — Y M. Lee

(74) *Attorney, Agent, or Firm* — Kilpatrick Townsend & Stockton LLP

(57) ABSTRACT

Described are embodiments of a light engine installation kit and methods of installation that allow a single technician to install large, heavy, or awkwardly shaped light engines into new or existing fixture housings. The installation kits include mounting brackets that install into the fixture housing. The mounting brackets can then support the light engine by a retention tab at one end, and a tether at the other. In this intermediate position, an installer can complete the wiring before raising the light engine into its final position. Also described are lenses, wireway covers, reflectors, and end caps that provide improved sealing of the lens compartment of a light engine. The fitting of the parts provides better sealing to prevent dirt, debris, or insects from migrating into the lens compartment of the light engine and causing reduced light output or unsightly dark spots in the lens.

19 Claims, 12 Drawing Sheets

(56) References Cited

U.S. PATENT DOCUMENTS

| | | | |
|---|---|---|---|
| D140,343 | S | 2/1945 | Nitardy |
| 2,525,537 | A | 10/1950 | Fletcher |
| 2,825,798 | A | 3/1958 | Zingone |
| 3,117,729 | A | 1/1964 | Silvers et al. |
| 3,159,352 | A | 12/1964 | Wakefield et al. |
| 3,299,264 | A | 1/1967 | Lipscomb |
| 4,053,762 | A | 10/1977 | Barbson |
| 4,323,954 | A | 4/1982 | Florence et al. |
| 4,338,653 | A | 7/1982 | Marrero |
| 5,025,355 | A | 6/1991 | Harwood |
| 5,381,320 | A | 1/1995 | Jordan |
| 5,791,764 | A | 8/1998 | Jaksich |
| D399,586 | S | 10/1998 | Ranieri et al. |
| D413,402 | S | 8/1999 | Ranieri et al. |
| 6,210,019 | B1 | 4/2001 | Weathers |
| 6,305,816 | B1 | 10/2001 | Corcorran et al. |
| 6,739,734 | B1 | 5/2004 | Hulgan |
| D496,121 | S | 9/2004 | Santoro |
| 6,908,212 | B2 | 6/2005 | Schultz |
| 6,929,382 | B2 | 8/2005 | Kuisma |
| 6,984,055 | B2 | 1/2006 | McCarthy et al. |
| 7,090,375 | B2 | 8/2006 | Kuisma |
| D541,467 | S | 4/2007 | Gould |
| D541,468 | S | 4/2007 | Mayfield et al. |
| D545,481 | S | 6/2007 | Mayfield et al. |
| D545,482 | S | 6/2007 | Mayfield et al. |
| D545,483 | S | 6/2007 | Mayfield et al. |
| D545,485 | S | 6/2007 | Hargreaves |
| 7,229,192 | B2 | 6/2007 | Mayfield et al. |
| D545,992 | S | 7/2007 | Mayfield et al. |
| D561,930 | S | 2/2008 | Hukle et al. |
| 7,530,716 | B2 | 5/2009 | Mayfield et al. |
| D597,701 | S | 8/2009 | Tran et al. |
| D602,187 | S | 10/2009 | Fabbri et al. |
| D602,188 | S | 10/2009 | Fabbri et al. |
| 7,607,796 | B2 | 10/2009 | Meyer |
| D604,000 | S | 11/2009 | Fowler et al. |
| 7,635,198 | B2 | 12/2009 | Mayfield et al. |
| D608,932 | S | 1/2010 | Castelli |
| 7,674,005 | B2 | 3/2010 | Chung et al. |
| D616,138 | S | 5/2010 | Lasthein et al. |
| D617,487 | S | 6/2010 | Fowler et al. |
| D643,572 | S | 8/2011 | Lown et al. |
| D645,192 | S | 9/2011 | Chung et al. |
| D646,421 | S | 10/2011 | Chung et al. |
| D653,375 | S | 1/2012 | Chung et al. |
| 8,092,037 | B2 | 1/2012 | Kassay et al. |
| 8,100,551 | B2 | 1/2012 | Mayfield et al. |
| D657,904 | S | 4/2012 | Mayfield et al. |
| D660,497 | S | 5/2012 | Chung et al. |
| D661,422 | S | 6/2012 | Ferguson et al. |
| D661,423 | S | 6/2012 | Ferguson et al. |
| D667,157 | S | 9/2012 | Ferguson et al. |
| D671,258 | S | 11/2012 | Ferrier et al. |
| D673,324 | S | 12/2012 | Mayfield, III et al. |
| D685,122 | S | 6/2013 | Kim |
| D687,177 | S | 7/2013 | Grandsart et al. |
| 8,511,850 | B2 | 8/2013 | Hawkins et al. |
| 8,523,383 | B1 | 9/2013 | Grigore et al. |
| D692,610 | S | 10/2013 | Sitarski et al. |
| 8,550,656 | B2 | 10/2013 | McCarthy, III et al. |
| 8,585,241 | B2 | 11/2013 | Tsai |
| D701,341 | S | 3/2014 | Mayfield, III et al. |
| 8,672,508 | B2 | 3/2014 | Pearson et al. |
| D701,989 | S | 4/2014 | Rodgers et al. |
| D701,990 | S | 4/2014 | Rodgers et al. |
| 8,696,154 | B2 | 4/2014 | Hutchens |
| 8,764,220 | B2 | 7/2014 | Chan et al. |
| 8,789,966 | B2 | 7/2014 | McCanless et al. |
| 8,888,316 | B2 | 11/2014 | Handsaker |
| D721,198 | S | 1/2015 | Glasbrenner |
| 8,960,962 | B2 | 2/2015 | Mccane et al. |
| 9,062,867 | B2 | 6/2015 | Rodgers et al. |
| 2001/0002012 | A1* | 5/2001 | Yeaton ..... B65D 41/0442 215/45 |
| 2005/0157498 | A1 | 7/2005 | Dicken |
| 2006/0221606 | A1 | 10/2006 | Dowling |
| 2008/0266849 | A1 | 10/2008 | Nielson et al. |
| 2009/0002990 | A1 | 1/2009 | Becker et al. |
| 2009/0046457 | A1 | 2/2009 | Everhart |
| 2010/0033964 | A1 | 2/2010 | Choi et al. |
| 2010/0134046 | A1 | 6/2010 | Holder et al. |
| 2010/0237798 | A1 | 9/2010 | Wolf et al. |
| 2011/0141729 | A1 | 6/2011 | Yang et al. |
| 2011/0228528 | A1 | 9/2011 | Yang et al. |
| 2012/0113628 | A1 | 5/2012 | Burrow et al. |
| 2012/0293999 | A1 | 11/2012 | Chung et al. |
| 2013/0033861 | A1 | 2/2013 | Orton |
| 2013/0083524 | A1 | 4/2013 | Devorris |
| 2013/0176716 | A1 | 7/2013 | Pratt et al. |
| 2013/0223057 | A1 | 8/2013 | Gassner et al. |
| 2013/0294059 | A1 | 11/2013 | Galluccio et al. |
| 2014/0071669 | A1 | 3/2014 | McCarthy et al. |
| 2014/0078727 | A1 | 3/2014 | Lu et al. |
| 2014/0104825 | A1 | 4/2014 | Gassner et al. |
| 2014/0112014 | A1 | 4/2014 | Lin et al. |
| 2014/0119015 | A1 | 5/2014 | Morgan |
| 2014/0126195 | A1 | 5/2014 | Dixon |
| 2014/0126196 | A1 | 5/2014 | Dixon et al. |
| 2014/0126197 | A1 | 5/2014 | Dixon et al. |
| 2014/0126199 | A1 | 5/2014 | Heeter et al. |
| 2014/0160742 | A1 | 6/2014 | Rodgers et al. |
| 2014/0168961 | A1 | 6/2014 | Dubord |
| 2014/0204572 | A1 | 7/2014 | Spinelli |
| 2014/0226322 | A1 | 8/2014 | Chan et al. |
| 2014/0268748 | A1 | 9/2014 | Lay et al. |
| 2014/0355272 | A1 | 12/2014 | Chou |
| 2015/0003069 | A1 | 1/2015 | Medendorp, Jr. et al. |
| 2015/0003070 | A1 | 1/2015 | Medendorp, Jr. et al. |
| 2015/0016100 | A1 | 1/2015 | Ishii |
| 2015/0159848 | A1* | 6/2015 | Sieberth ..... F21V 23/06 362/311.02 |
| 2016/0097512 | A1* | 4/2016 | De Oliveira ..... F21S 8/00 362/217.05 |

OTHER PUBLICATIONS

CA 2,919,802, "Office Action," dated Mar. 14, 2018, 5 pages.
CA 2,919,802, "Notice of Allowance," dated Jul. 25, 2018, 1 page.

* cited by examiner

EASY INSTALL LIGHT ENGINE RETROFIT KIT AND METHOD FOR USING SAME

CROSS REFERENCE TO RELATED APPLICATIONS

This application claims the benefit of U.S. Provisional Application Ser. No. 62/112,017 ("the '017 application"), filed on Feb. 4, 2015 and entitled "LED Retrofit Kit Installation and Method for Using Same." The '017 application is hereby incorporated in its entirety by this reference.

FIELD OF THE INVENTION

Embodiments of the invention relate to retrofit and installation kits for light engines into new or existing fixtures.

BACKGROUND

The terms "invention," "the invention," "this invention" and "the present invention" used in this patent are intended to refer broadly to all of the subject matter of this patent and the patent claims below. Statements containing these terms should be understood not to limit the subject matter described herein or to limit the meaning or scope of the patent claims below. Embodiments of the invention covered by this patent are defined by the claims below, not this summary. This summary is a high-level overview of various aspects of the invention and introduces some of the concepts that are further described in the Detailed Description section below. This summary is not intended to identify key or essential features of the claimed subject matter, nor is it intended to be used in isolation to determine the scope of the claimed subject matter. The subject matter should be understood by reference to appropriate portions of the entire specification of this patent, any or all drawings and each claim.

Installation of light engines, especially for large or heavy lighting systems, may be difficult or dangerous and require multiple installers. Often times, a light engine may need to be retrofit into an existing lighting fixture, which may be mounted to a ceiling or other high structure. A single technician often cannot install a light engine alone because it may be too large, heavy, or the fixture housing is in a position that is not easily accessible. As a result, installation of a light engine, either into a new or existing fixture housing, may require multiple installers, increasing costs of installation or replacement, or requiring more time from available labor resources.

The lens compartment of many light engines may collect dust, dirt, insects, and other debris. Generally, light engines do not include barriers to the ingress of dirt, debris, and insects. Over time, these outside contaminants can collect within the lens compartment of a light engine. The light engine output is reduced, and unsightly dark spots may become visible, particularly when the light engine is in operation.

SUMMARY

Aspects of the present disclosure relate to installation kits to install light engines into new or existing fixture housings. The installation kits include mounting brackets that install into a new or existing fixture housings. The kit also may include one or more end caps, a retainer bracket, and a tether bracket that attach to the light engine that is to be installed. The retainer bracket has a retainer tab that engages with a receiver slot on the mounting bracket. One end of the light engine can be hung and supported by the retainer tab when it is engaged with one of the mounting brackets. The other end of the light engine can then be supported by a tether attached to the tether bracket. In this position, with one end of the light engine hanging from the fixture housing by the tether, a single installer may make all the necessary electrical connections. After the electrical connections have been completed, the installer may then raise the tethered end of the light engine into the fixture housing and secure it.

Aspects of the present disclosure also relate to methods and components for better sealing of the lens compartment of a light engine. The light engine may have a lens with flanges that engage with the wireway cover of the light engine to form a tighter, more complete seal. The lens may also include ridges that abut the edges of the wireway cover to give an extra sealing point. The light engine may also include end caps with recesses that are designed to fit around the ends of the lens and reflector. The recess provides a better seating point for the lens and reflector, and helps to better seal the lens compartment. The reflector may also include a special extension to provide better engagement with the end cap. These multiple seals help prevent intrusion of bugs, dust, or other debris over longer periods of time than with traditional light engines.

DETAILED DESCRIPTION

The subject matter of embodiments of the present invention is described here with specificity to meet statutory requirements, but this description is not necessarily intended to limit the scope of the claims. The claimed subject matter may be embodied in other ways, may include different elements or steps, and may be used in conjunction with other existing or future technologies. This description should not be interpreted as implying any particular order or arrangement among or between various steps or elements except when the order of individual steps or arrangement of elements is explicitly described.

Embodiments of the present invention relate to installation kits for installing an LED light engine into a new or existing fixture housing and methods of installation using the kit. While the installation kit is described and illustrated for use in a suspended fixture, it can be used in other types of fixtures including, but not limited to, surface mounted and troffer type fixtures. The kit may be supplied with a light engine or it may be used with light engines not included in the kit. It should be appreciated that any combination of the following described components, including individual components, may be used to facilitate installation of a light engine.

The depicted light engines may include a reflector onto which a wireway cover is mounted on the underside of the reflector base, a plurality of LEDs mounted on the wireway cover, a lens provided over the LEDs, end caps positioned at the ends of the reflector, a driver(s) for powering the LEDs and supported on the upper side of the reflector base, as well as associated light engine wiring and hardware. However, the installation kit described herein is by no means limited for use with the light engine disclosed. Rather, it may be used with any type and configuration of light engine.

Figure 1:
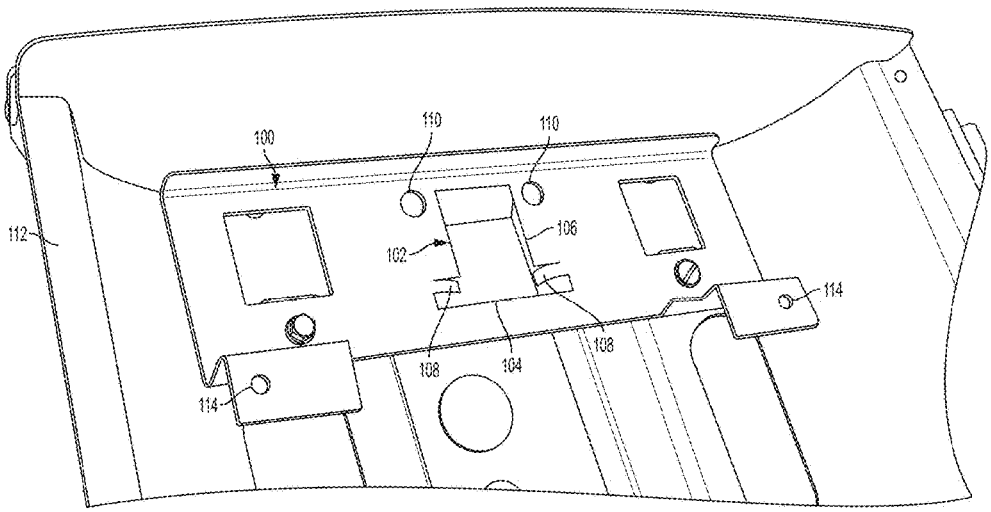
FIG. 1 is a perspective view of a mounting bracket in a fixture housing, according to certain embodiments of the present invention.

FIG. 1 is a perspective view of a mounting bracket 100 with a receiver slot 102 having a wide slot portion 104, a narrow slot portion 106, and upwardly angled tabs 108. The mounting bracket 100 may also include one or more tether holes 110, fastener holes 114, and, as shown, may be installed in a fixture housing 112 intended to house a light engine. The kit may include at least one mounting bracket 100 for mounting into the fixture housing 112 of either a pre-existing or new fixture. In one embodiment, a mounting bracket 100 may be installed within the fixture housing 112 proximate each end of the fixture housing 112. The mounting brackets 100 may be identical or not. The mounting bracket 100 may be mounted to the fixture housing 112 using tabs, slots, or fasteners, such as screws, rivets, or the like, which take advantage of the existing geometry or holes of the fixture housing 112. The mounting bracket 100 is preferably adapted to be used with the fixture housing 112 without the requirement for modification to the fixture housing 112. However, the fixture housing 112 may be modified to accept the mounting bracket 100, or the mounting bracket 100 may be modified to fit a particular fixture housing 112. For example, in certain embodiments, a blank or standardized mounting bracket 100 may be provided that is cut, drilled, or otherwise modified on-site to fit a particular fixture housing 112. In some embodiments, the mounting bracket 100 may include markings, pilot holes, or other features to assist an installer in modifying the mounting bracket 100 for commonly used or standardized fixture housings 112.

The mounting bracket 100 may include a receiver slot 102 having a wide slot portion 104 and narrow slot portion 106. Upwardly angled tabs 108 (angled into the page as shown in FIG. 1) are provided at the intersection of the wide slot portion 104 and the narrow slot portion 106 of the receiver slot 102. The receiver slot 102 is sized to receive a retainer tab 204, shown in FIGS. 2 and 3, which may be affixed to a first end of a light engine or an end cap 200 as described below.

Still referring to FIG. 1, the mounting bracket 100 also may include one or more tether holes 110. The tether holes 110 are adapted to accept a tether 226 which may be affixed to the second end of the light engine 222 or another end cap 200 (see FIGS. 4 and 5). The tether 226 may terminate in a tether clip 230, which may be a snap clip or any other type of fixation device which is compatible with the tether holes 110 in the mounting bracket 100.

Figure 2:
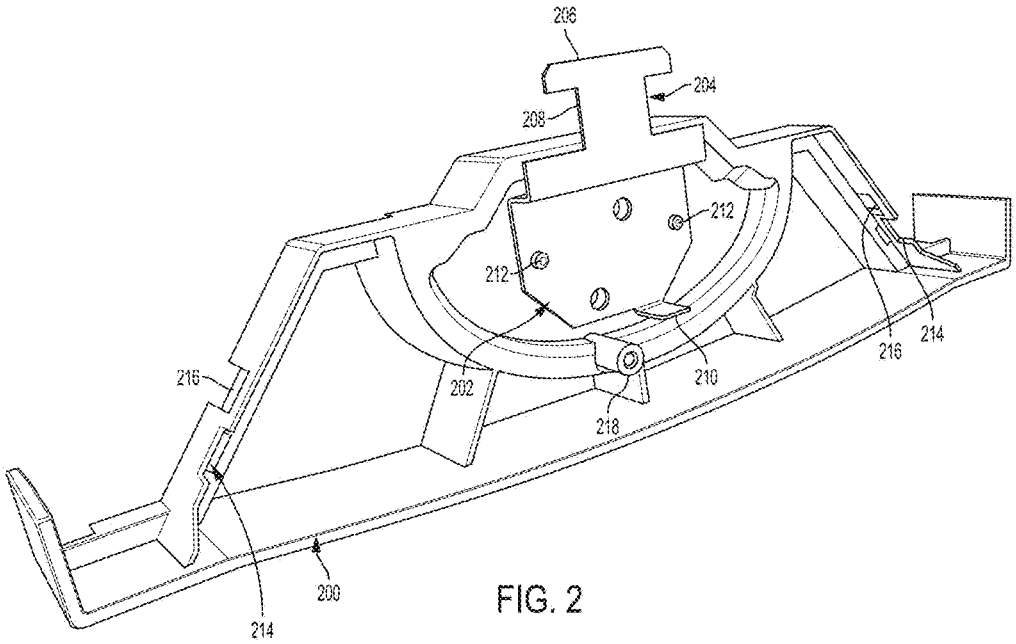
FIG. 2 is a perspective view of an end cap with retainer tab, according to certain embodiments of the present invention.
Figure 3:
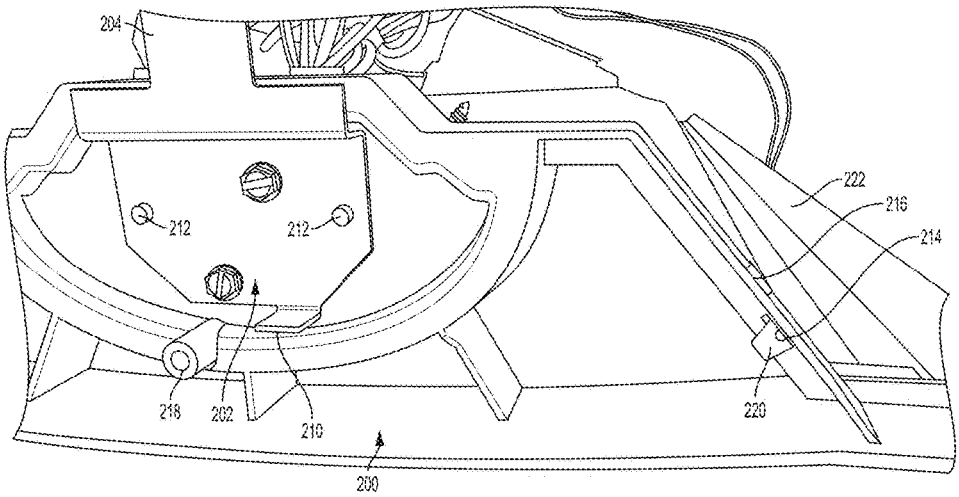
FIG. 3 is a perspective view of an end cap with retainer tab on a light engine, according to certain embodiments of the present invention.

End caps 200 are mounted on each end of the light engine and are designed to engage the mounting brackets 100 mounted within the fixture housing 112. FIGS. 2-7 illustrate various embodiments of end caps 200. FIGS. 2 and 3 show an embodiment of an end cap 200 with optional locator pins 212, reflector tab recesses 214, cover tab apertures 216, and fastener boss 218.

A retainer bracket 202 is mounted on the outer side of one of the end caps 200. The retainer bracket 202 has a retainer tab 204 with a wide tab portion 206, a narrow tab portion 208, and an optional interference tab 210. The retainer tab 204 is designed to fit within and interlock with the receiver slot 102 of the mounting bracket 100 described above. The wide tab portion 206 is slightly narrower than the wide slot portion 104 and wider than the narrow slot portion 106 of the receiver slot 102. The narrow tab portion 208 is narrower than the narrow slot portion 106 of the mounting bracket 100.

The size and shape of the wide tab portion 206 and narrow tab portion 208 are selected such that the wide tab portion 206 may pass through the wide slot portion 104. Once the wide tab portion 206 of the retainer tab 204 has passed through the wide slot portion 104 of the receiver slot 102, the retainer tab 204 may move into the narrow slot portion 106. In this position, the narrow tab portion 208 extends through the narrow slot portion 106, and the wide tab portion 206 interferes with the narrow slot portion 106 and cannot pass back through it. The retainer tab 204, and any load or weight supported by it, will be held by the interference of the wide tab portion 206 of the retainer tab 204 with the narrow slot portion 106 of the mounting bracket 100. The upwardly angled tabs 108 prevent the retainer tab 204 from sliding back into the wide slot portion 104 by interfering with the wide tab portion 206 before it enters the wide slot portion 104.

As shown, the retainer tab 204 may take on a T-shape that compliments a T-shaped receiver slot 102. Some embodiments of the retainer tab 204 and receiver slot 102 may have different shapes, features, or qualities. For example, the retainer tab 204 and/or receiver slot 102 may take on any size, shape, or geometry so long as the wide tab portion 206 may pass through the wide slot portion 104 and then interfere with the narrow slot portion 106. Also, the narrow slot portion 106 must be slightly wider than the narrow tab portion 208 so that the narrow tab portion 208 may pass through the narrow slot portion 106 while the wide tab portion 206 interferes with the narrow slot portion 106. In certain embodiments, alternative structures may replace the retainer tab 204. For example, a short tether with a ball or other structure on the end may serve the same function as the retainer tab 204 and interact with the receiver slot 102.

Figure 4:
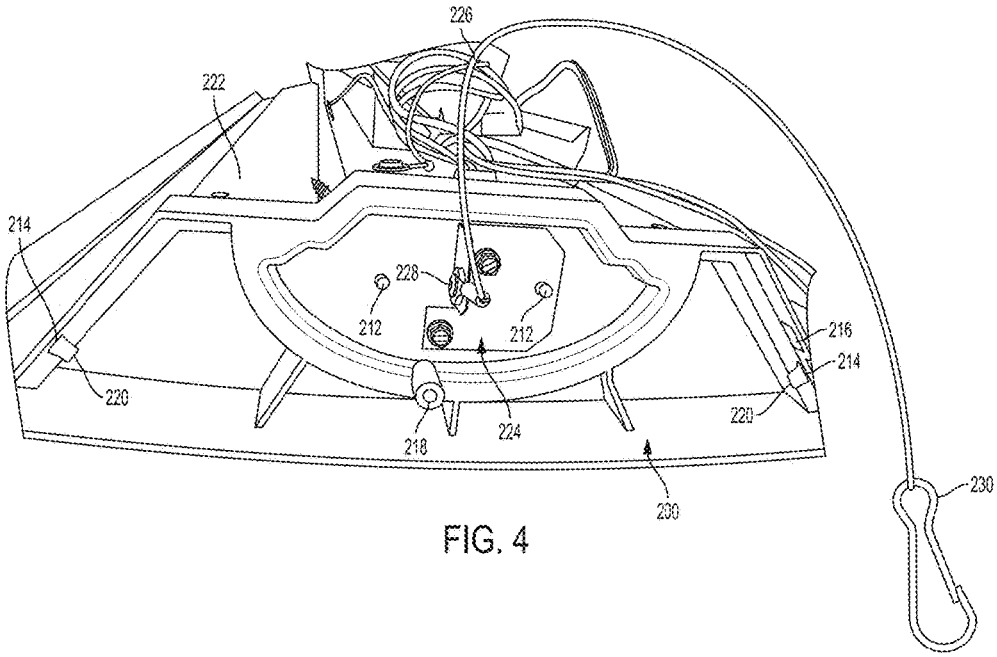
FIG. 4 is a perspective view of an end cap with tether on a light engine, according to certain embodiments of the present invention.
Figure 5:
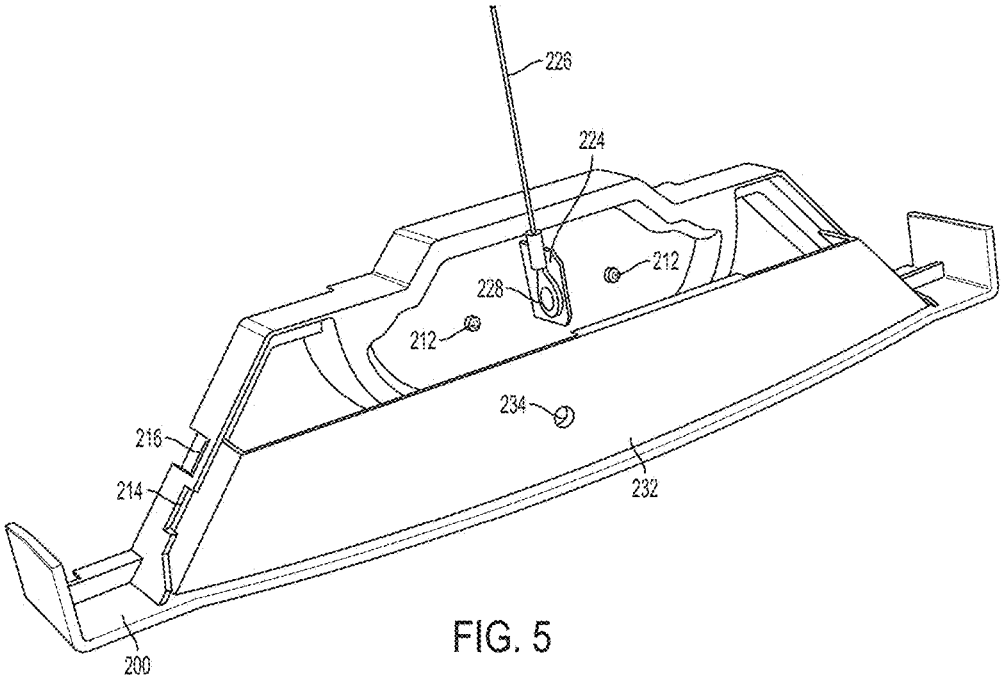
FIG. 5 is a perspective view of an end cap with tether and cover, according to certain embodiments of the present invention.
Figure 6:
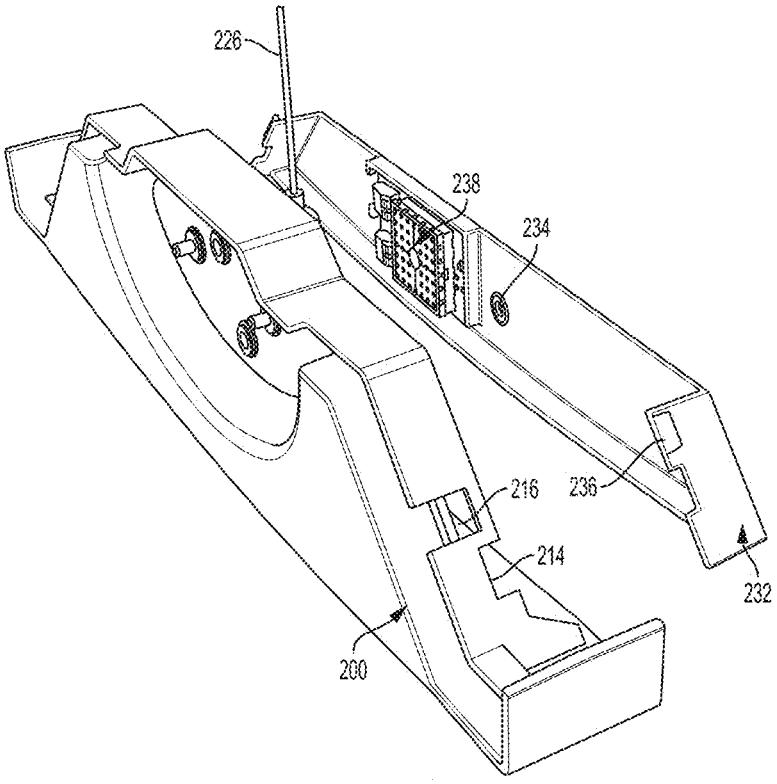
FIG. 6 is an assembly view of the end cap and cover of FIG. 5.

FIGS. 4-6 show exemplary embodiments of an end cap 200 with locator pins 212, reflector tab recesses 214, cover tab apertures 216, and a fastener boss 218. A tether bracket 224 with a tether 226 may be affixed to or through the end cap 200. The tether 226 may have a tether clip 230, or other mechanism to engage and secure the tether 226 to the mounting bracket 100 at one of the tether holes 110, and a fastener 228, such as a screw, rivet, or the like, to affix the tether 226 to the tether bracket 224. Once the tether 226 is attached via the tether clip 230 to the tether hole 110 of the mounting bracket 100, the tether 226, through the tether bracket 224 and/or the end cap 200, may support the weight of a light engine 222 during installation of the light engine into a fixture housing 112.

Referring to FIGS. 5 and 6, a cover 232 with a fastener hole 234 and one or more cover tabs 236 may be attached to the outer face of the end cap 200 to impart a more polished appearance to the fixture and/or to create an enclosed space for electronics or other hardware. The cover tabs 236 may engage with the cover tab apertures 216 on the end cap to snap the cover 232 onto the end cap 200. To further secure the cover 232, a fastener may be installed through the fastener hole 234 and into the fastener boss 218 on the end cap 200. While shown here with reference to an end cap 200 with a tether bracket 224, the cover 232 may be used in conjunction with any end cap 200 and/or light engine 222 shown or described in reference to FIGS. 1-12. In certain embodiments, the cover 232 may interact with a light engine 222 that has an end cap 200 integrated into other parts of the light engine 222, or that has no end cap whatsoever.

Figure 7:
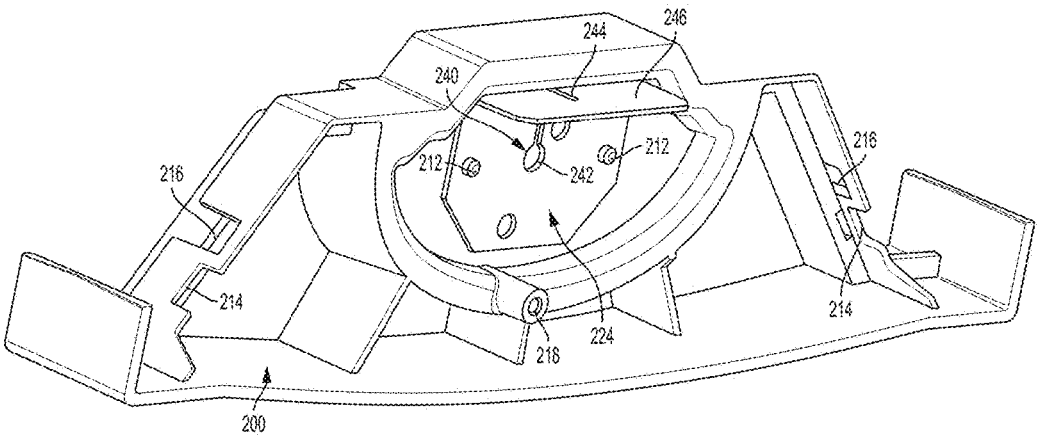
FIG. 7 is a perspective view of an end cap with tether bracket, according to certain embodiments of the present invention.
Figure 8:
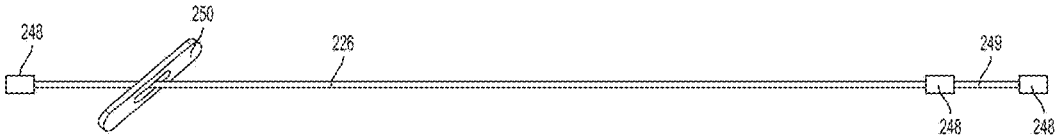
FIG. 8 is a plan view of a tether according to certain embodiments of the present invention.

FIGS. 7 and 8 show exemplary embodiments of an end cap 200 with an alternative embodiment of a tether bracket 224 and a tether 226 affixed to it. The end cap 200 may include locator pins 212, reflector tab recesses 214, cover tab apertures 216, and a fastener boss 218. Tether bracket 224 includes a tether bracket slot 240 having an aperture 242, channel 244, and tether bracket extension 246. The tether bracket 224 with tether bracket slot 240 is designed to engage with the tether 226 of FIG. 8 having stops 248. Two of the stops 248 are located near one end of the tether 226 and define a grip length 249. The tether 226 with the stops 248 and grip length 249 is designed to engage with the tether bracket slot 240 shown in FIG. 7. The tether 226 also includes a toggle 250 that can be used to attach the tether 226 to the tether hole 110 on the mounting bracket 100. To install the tether 226 in the mounting bracket 100, the toggle 250 may be aligned with the tether 226 and inserted through the tether hole 110 lengthwise, then turned perpendicular to the tether 226 and pulled against the tether hole 110. The toggle 250 will then not be able to pass through the tether hole 110. A stop 248 on the end of the tether 226 prevents the tether 226 from slipping through the toggle 250, and transfers the load from the light engine 222 to the mounting bracket 100.

Still referring to FIGS. 7 and 8, the tether 226 may be inserted into the tether bracket 224 prior to affixing the tether bracket 224 to the light engine 222 and/or end cap 200. The aperture 242 of the tether bracket slot 240 is sized to be larger than the stops 248 on the tether 226. The tether 226 is inserted through the aperture 242 until the aperture 242 is between the two stops 248 that define the grip length 249. The grip length 249 can then translate into the channel 244, which is sized to be larger than the tether 226 but smaller than the tether stops 248. The tether bracket 224 may then be affixed to the light engine 222 and/or end cap 200. The engagement of the tether bracket 224 with the end cap 200 confines the tether 226 into the channel 244. The stops 248 will then prevent the tether 226 from exiting the channel 244, and may transfer the load of the light engine 222 from the tether bracket 224 into the tether 226 and into a mounting bracket 100. A tether 226 with stops 248 and a grip length 249 that engages a tether bracket 224 with a tether bracket slot 240 may provide a more secure hold compared to a tether 226 with a fastener 228, particularly when the tether 226 is used to support a heavy light engine 222 or is permanently attached to the light engine 222 when it is installed into the fixture housing 112.

The tether bracket 224 may also include a tether bracket extension 246 extending out and away from the end cap 200. The tether bracket extension 246 may be sized and shaped so as to cover any holes, apertures, or, in the case of an installation kit with identical mounting brackets 100, the receiver slot 102. The tether bracket extension 246 may then, once the light engine 222 is installed within the fixture housing 112, provide a barrier to fire and/or electrical discharges. As a result, the end cap 200 may be made from cheaper materials that are not fire rated and/or enclosure rated. Similarly, the retainer tab 204 as shown in FIGS. 2 and 3 may serve as a barrier to fire and/or electrical discharges. In certain embodiments, the retainer tab 204 may be sized closely to the receiver slot 102 when it is engaged to prevent fire, sparks, or arcing electricity from passing through the receiver slot 102 and contacting the end cap 200. In some embodiments, the clearance between the retainer tab 204 and the receiver slot 102 may be approximately 0.060 inches.

Referring to FIGS. 2-7, a number of additional features or details may be included on the end caps 200, retainer bracket 202, and/or tether bracket 224 to provide additional function or for ease of manufacture and assembly. For example, the end cap 200 may include locator pins 212 to help align and locate the retainer bracket 202 and/or tether bracket 224 during installation, either on site or in a manufacturing facility. The use of locator pins 212 may also facilitate installation of the retainer bracket 202 and/or tether bracket 224 by preventing the rotation or misalignment of the retainer bracket 202 and/or tether bracket 224 as the first fastener, such as a screw, bolt, or rivet, is installed. Furthermore, as shown in FIGS. 3 and 4, the end cap 200 may include reflector tab recesses 214 that may receive a reflector tab 220 from the light engine 222. When the end cap 200 is installed on the end of a light engine 222, the reflector tabs 220 may be folded over to provide a clamping or seating force on the ends of the end cap 200. During installation, the reflector tabs 220 may help prevent distortion of the end cap 200 and/or movement relative to the light engine 222 when fasteners, such as screws or rivets, are installed through the retainer bracket 202 and/or tether bracket 224.

Figure 11:
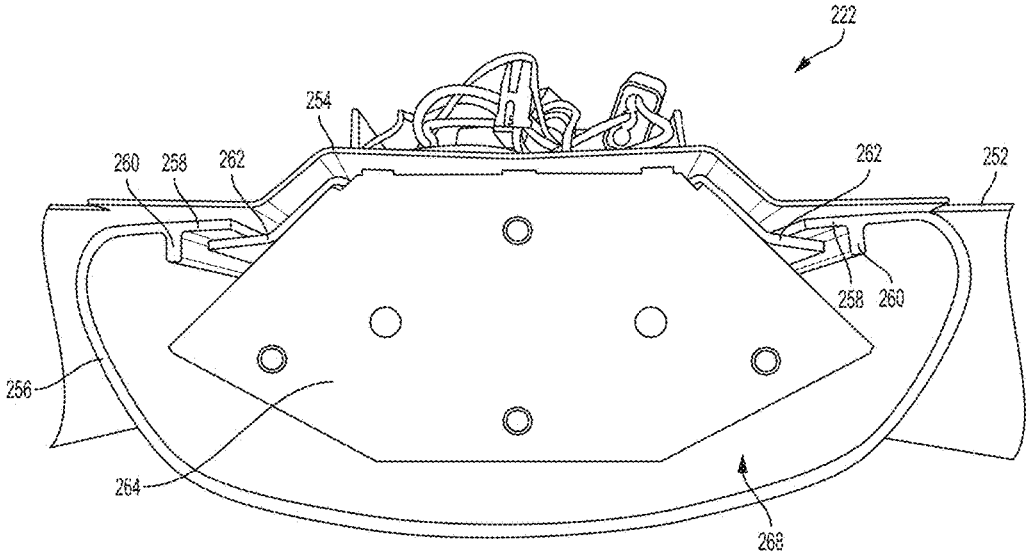
FIG. 11 is an end view of a light engine without an end cap, according to certain embodiments of the present invention.

The retainer bracket 202 and tether bracket 224 may be attached to the light engine 222 via end plates 264 provided with or integrated into the light engine 222 (visible in FIG. 11). The end plates 264 may have a number of holes which may accept fasteners such as, but not limited to, screws, bolts, and/or rivets. The retainer bracket 202 and/or tether bracket 224 may be mounted to the end plate 264 by fasteners that extend through the end cap 200. In certain embodiments, the load is borne through the end plate 264, and the fasteners are not threaded into the end cap 200. Here, the end cap 200 provides a sealing function and closes off the end of the light engine 222. However, it is also possible for the retainer bracket 202 and/or tether bracket 224 to be attached to the end cap 200 or both the end cap 200 and the end plate 264 so that the load of the light engine 222 is fully or partially supported by the end cap 200.

Still referring to FIGS. 2-7, a number of alternative embodiments of the light engine 222, end cap 200, and associated parts of the installation kit are possible. For example, the end caps 200 may be included in the light engine 222, either as separate parts or integrated with one or more other parts of the light engine 222. In this case, the kit may only include the mounting brackets 100, retainer bracket 202, tether bracket 224, and associated hardware. In other embodiments, the end caps 200 may be integral with the retainer bracket 202 and/or tether bracket 224 and be installed on the light engine 222 in a factory or on-site. So long as the mounting bracket 100, retainer bracket 202, tether bracket 224, and their associated hardware and parts maintain their functions as described, they may be integral with or produced separately from any other part included in the installation kit. In certain embodiments, the light engine 222 may be produced with parts from the installation kit included or integral with light engine 222 parts and used as a complete system.

The installation kit may also be adapted for use with other lighting technologies, such as new light engine technology or Indoor Positioning systems. The installation kit may then facilitate the retrofit of new lighting technologies into existing fixture housings 112. For example, the Indoor Positioning system uses modulation of the light engine 222 to produce a pattern that is recognizable by a cellular phone or other devices. The modulation of the light engine 222 conveys the identification of the light engine which could have a known position within a retail store or other large, lighted space. Oftentimes these types of fixture housings 112 are double housings that contain two light engines 222. In order for a cellular phone or other device to detect the particular modulation of two adjacent light engines 222, there must be sufficient dark space between the two light engines 222. To accommodate this, the end caps 200 may be sized such that they provide the dark space between adjacent light engines 222 to improve the function of the Indoor Positioning system. Furthermore, the cover 232 may be sized or otherwise adapted for use with electronics that may be necessary for a particular lighting technology. In certain embodiments, as shown in FIG. 6, the cover 232 may provide support, protection, or an enclosed space for an electronic device 238, such as a Bluetooth radio or the like.

The installation kit may also provide error-proofing functions during assembly or installation of a light engine 222 to ensure that it functions correctly with other lighting technologies. As shown in FIGS. 2-7, the electronic device 238 may be mounted inside the cover 232 of the end cap 200 with the tether bracket 224. By contrast, the retainer bracket 202 may include an interference tab 210 that projects into the space enclosed by the cover 232 and prevents installation of an electronic device 238 in combination with the retainer bracket 202. The interference tab 210 may then ensure that the electronic device 238, such as a Bluetooth radio in the case of the Indoor Positioning system, is located correctly in reference to the light engine 222 and/or fixture housing 112. Similarly, the tether bracket 224 may include an interference tab 210 to prevent installation of an electronic device 238, while the retainer bracket 202 does not have an interference tab 210.

FIGS. 9A-9D shows an exemplary installation method of a light engine 222 into a fixture housing 112. To mount the first end of the light engine 222, which has already been assembled with end caps 200 and their associated parts, onto the fixture housing 112, the retainer tab 204 is inserted upwardly into the wide slot portion 104 of the receiver slot 102 on the mounting bracket 100. The light engine 222 is then displaced laterally towards the center of the fixture housing 112, past the angled tabs 108 and into the narrow slot portion 106 of the receiver slot 102. The narrow slot portion 106 of the receiver slot 102 is narrower than the wide tab portion 206 of the retainer tab 204 so that the retainer tab 204 may not pass vertically through the narrow slot portion 106 of the receiver slot 102. Furthermore, the angled tabs 108 restrict lateral movement of the retainer tab 204 back into the wide slot portion 104 of the receiver slot 102 so as to prevent the first end of the light engine 222 from disengaging from the fixture housing 112. In this way, the light engine 222 is securely supported in the fixture housing 112 at its first end so as to afford the installer the ability to use both hands to complete installation of the light engine 222 into the fixture housing 112.

Figure 9A:
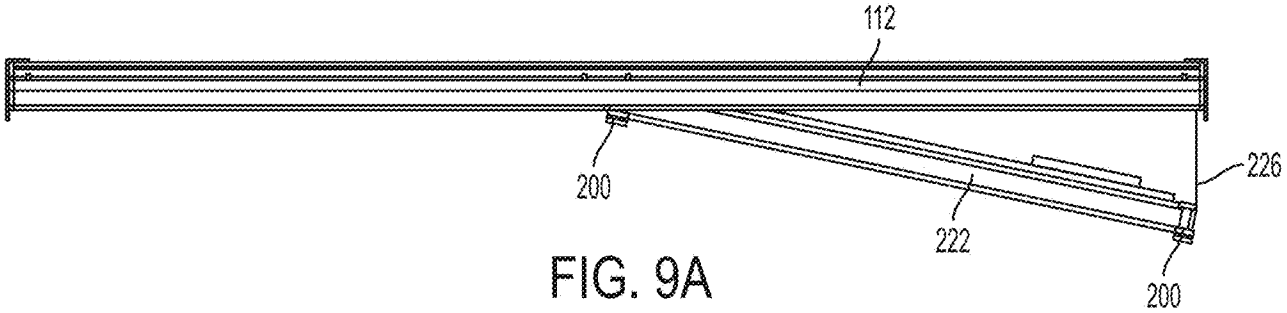
FIGS. 9A-9D are perspective views of the installation of a light engine into a fixture housing, according to certain embodiments of the present invention.
Figure 9D:
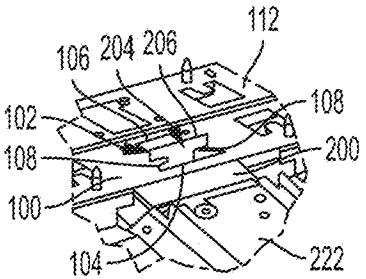
Figure 9C:
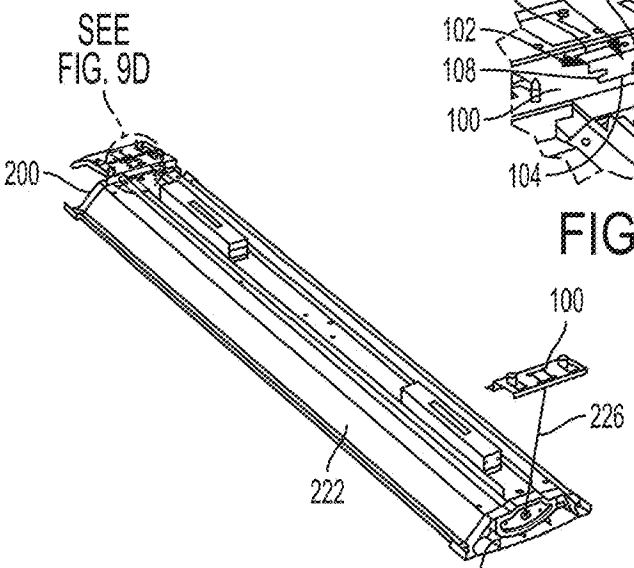
Figure 9B:
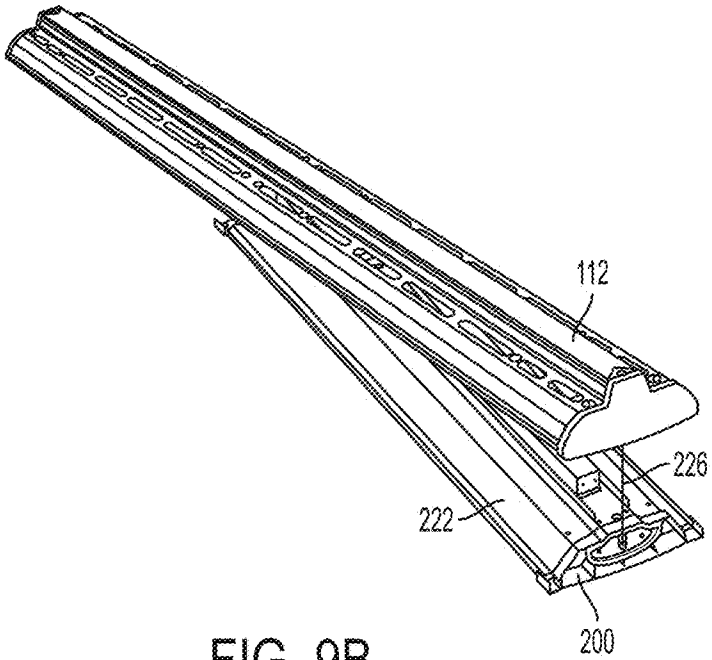

During installation, the tether clip 230, toggle 250, or other fixation device, may be attached to the tether hole of the mounting bracket 100. The tether 226 may then support the second end of the light engine 222 in a lower position relative to the first end of the light engine (see FIGS. 9A and 9B), thereby allowing the installer access to the back side of the light engine 222 to make the necessary electrical connections (e.g., install or connect the bond wire, ground, power source, etc.). It may be desirable for the mounting brackets 100 to be identical in that they both include features for engaging the retainer tab 204 and tether 226 of the light engine 222. This allows the installer to install the light engine 222 in either direction without concern for which side of the host fixture housing 112 any particular mounting bracket 100 is located on. However, it is contemplated that the mounting brackets may be different (e.g., one mounting bracket 100 having the receiver slot 102 and the other mounting bracket 100 having the tether holes 110). In certain embodiments, the installation of the light engine 222 into the fixture housing 112 may require a particular alignment or arrangement of the retainer bracket 202 and tether 226. For example, in a long fixture housing 112, as shown in FIGS. 9A and 9B, power input to the light engines 222 may come from the ends of the fixture housing 112. The light engine 222 should be installed in this fixture housing 112 with the retainer bracket 202 near the center so that the tether 226, and improved access to the back of the light engine 222, is located near the power input at the outside of the fixture housing 112. Similarly, other fixture housings 112 may have a power input at the center, and require a different installation arrangement. The installation kit may therefore be provided with mounting brackets 100 or other hardware specifically suited to any particular alignment or arrangement for a particular light engine 222, fixture housing 112, or installation.

After the installer has made the necessary electrical connections, he/she may then raise the second, end of the light engine 222 with the tether 226 to seat it on the mounting bracket 100 and/or fixture housing 112. The installer may then use mounting screws, bolts, or other fasteners to secure the second end of the light engine 222 into the fixture housing 112. While such screws or other fasteners could directly engage and connect the light engine 222 to the fixture housing 112, in some embodiments the mounting screws or fasteners pass through mounting holes in the light engine 222 and into fastener holes 114 on the mounting bracket 100 (see FIG. 1). In this way, the light engine 222 is retained in the fixture housing 112 via the mounting bracket 100. Use of the mounting brackets 100 to retain the light engine 222 in the fixture housing 112 renders the installation kit universally compatible with fixture housings 112 of virtually any shape and configuration.

After securing the second end of the light engine 222 in the fixture housing 112, the installer can similarly secure the first end of the light engine 222 in the fixture housing 112. Engagement of the retainer tab 204 in the receiver slot 102 allows some movement or play between the first end of the light engine 222 and the mounting bracket 100 so as to permit the installer to align any mounting holes in the light engine 222 with the fastener holes 114 of the mounting bracket 100. The light engine 222 may also be supported solely by the retainer tab 204, not requiring fasteners on the retainer tab 204 end.

It should be appreciated that any number of modifications or alterations to the individual parts of the kit or steps of installation may be made and fall within the scope of the invention. For example, the tether 226 may be permanently mounted to the light engine 222 and left attached to the mounting bracket 100 after installation. The tether 226 could then facilitate servicing, maintenance, or replacement of the light engine 222 after the initial installation. The tether 226 may also be removed during installation. In yet another embodiment, the tether 226 may be provided with the kit or separately as a tool which is affixed to the light engine 222 and mounting bracket 100 during installation, then removed and used for the installation of subsequent light engines 222 using the installation kit.

Figure 10:
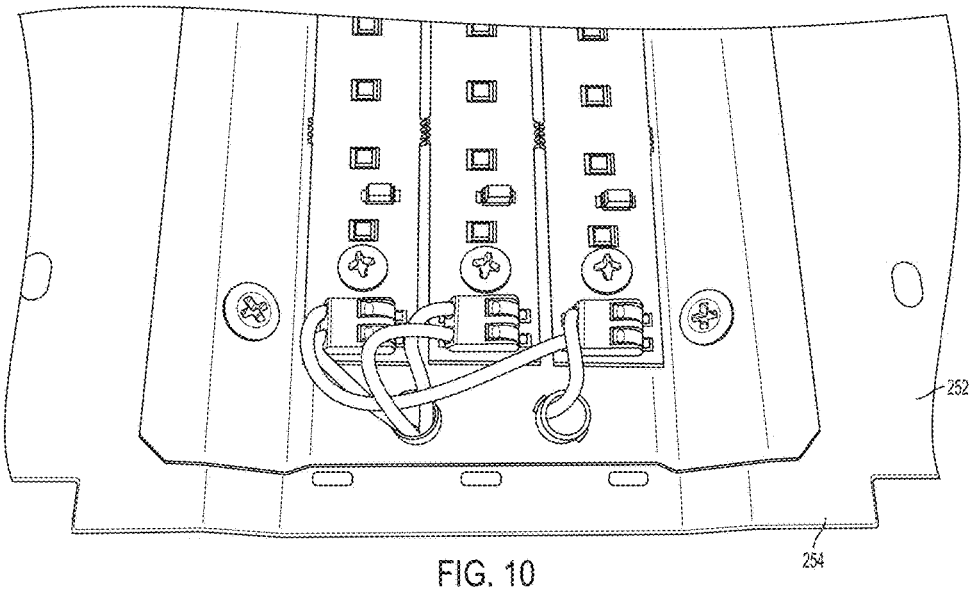
FIG. 10 is a plan view of a light engine reflector with extension, according to certain embodiments of the present invention.
Figure 12:
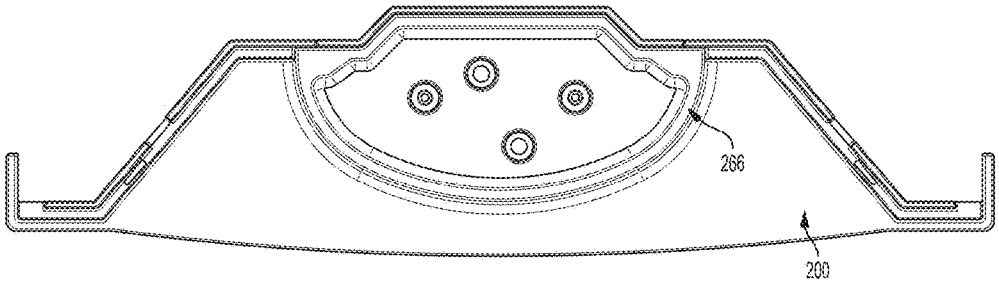
FIG. 12 is an end view of an end cap with recess, according to certain embodiments of the present invention.

Another aspect of the invention, as shown in FIGS. 10-12, relates to structures for sealing the lens compartment 268 of the light engine 222 defined by the lens 256 to prevent the ingress of insects, dust, and other small debris into the lens compartment 268. The side edges of the lens 256 may include one or more flanges 258 adapted to fit snugly with, and overlap, the side edges of the wireway cover 262. Ridges 260 may be provided, extending downwardly and perpendicular to the flanges 258 of the lens 256. These ridges 260 help locate and seat the lens 256 on the wireway cover 262 and serve as additional barriers to the intrusion of insects and other debris where they abut with the edges of the wireway cover 262.

One or more end caps 200 may be provided with recesses 266 shaped for receiving the ends of the reflector 252 as well as the ends of the lens 256. Seating of the ends of the lens 256 and reflector 252 within the end cap 200 recesses 266 serves to further seal the light engine 222 and prevent ingress of bugs and other debris within the lens compartment 268. In some embodiments, the ends of the light engine reflector 252 may be provided with reflector extensions 254 that seat even further within the recesses 266 on the end caps 200. In certain embodiments, sealing elements such as rubber, gasket material, foam, or the like may be, but do not have to be, provided between the end caps 200 and reflector 252, reflector extension 254, and/or lens 256 ends to enhance the seal between these components.

Finally, the end cap(s) 200 may be used as a mechanism to straighten or re-form a reflector 252 and/or lens 256 during installation. If the reflector 252 and/or lens 256 have been damaged or improperly formed during manufacture, forcing the ends of the reflector 252 and/or lens 256 into the recesses 266 of the end cap 200 may return it to, or close to, the intended shape. This may be advantageous to the installer for aesthetics, proper fit of the light engine 222 within the fixture housing, or to ensure proper alignment of two light engines 222 oriented end to end and accommodated in a single fixture housing. In certain embodiments, as shown in FIG. 11, the light engine 222 may also include an end plate 264. The end cap 200 may be affixed to the end plate 264 with screws, rivets, or other fasteners. The end plate 264 may provide a more secure mounting for the end cap 200, allowing the recess 266 to more firmly press onto the ends of the reflector 252, reflector extension 254, and/or lens 256, which may enhance the sealing of the lens compartment 268 and provide extra pressure to re-form or straighten the reflector 252 and/or lens 256.

Any of the above described components, parts, or embodiments may take on a range of shapes, sizes, or materials as necessary for a particular application of the described invention. The components, parts, or mechanisms of the described invention may be made of any materials selected for the suitability in use, cost, or ease of manufacturing. Materials including, but not limited to aluminum, stainless steel, fiber reinforced plastics, rubber, elastomers, carbon fiber, composites, polycarbonate, polypropylene, other metallic materials, or other polymers may be used to form any of the above described components.

Different arrangements of the components depicted in the drawings or described above, as well as components and steps not shown or described are possible. Similarly, some features and sub-combinations are useful and may be employed without reference to other features and sub-combinations. Embodiments of the invention have been described for illustrative and not restrictive purposes, and alternative embodiments will become apparent to readers of this patent. Accordingly, the present invention is not limited to the embodiments described above or depicted in the drawings, and various embodiments and modifications may be made without departing from the scope of the claims below.

That which is claimed is:

1. A light engine installation kit for installing a light engine into a housing, the kit comprising:

a first mounting bracket adapted to be affixed to the housing and comprising a receiver slot having a wide slot portion, a narrow slot portion, and at least one upwardly angled tab between the wide slot portion of the receiver slot and the narrow slot portion of the receiver slot;

a second mounting bracket adapted to be affixed to the housing and comprising a tether hole;

a first end cap adapted to be provided on a first end of the light engine and comprising a retainer bracket adapted to engage the receiver slot, wherein the retainer bracket comprises a retainer tab having a wide tab portion and a narrow tab portion, wherein the narrow slot portion of the receiver slot is wider than the narrow tab portion of the retainer tab and narrower than the wide tab portion of the retainer tab, and wherein the at least one upwardly angled tab ensures the narrow tab portion of the retainer tab remains within the narrow slot portion of the receiver slot in use; and a second end cap adapted to be provided on a second end of the light engine and comprising a tether bracket from which a tether extends, wherein the tether is adapted to engage with the tether hole on the second mounting bracket in use.

2. The light engine installation kit of claim 1, wherein the receiver slot is T-shaped.

3. The light engine installation kit of claim 2, wherein the retainer tab is T-shaped.

4. The light engine installation kit of claim 1, wherein the tether bracket comprises a tether slot comprising a tether aperture and a channel and wherein the tether comprises at least two tether stops, wherein the tether aperture is wider than the at least two tether stops, the channel is wider than the tether and narrower than the at least two tether stops, the at least two tether stops are affixed to the tether a distance apart defining a grip length, and the grip length may be inserted into the channel and bounded on either side by the at least two tether stops.

5. The light engine installation kit of claim 4, wherein the tether further comprises a toggle that engages with the tether hole on the second mounting bracket.

6. The light engine installation kit of claim 1, further comprising a cover affixed to at least one of the first end cap or the second end cap.

7. The light engine installation kit of claim 6, wherein the cover is affixed to the first end cap and wherein the retainer bracket on the first end cap further comprises an interference tab to prevent installation of an electronic device in a space enclosed within the cover.

8. The light engine installation kit of claim 7, wherein the electronic device comprises a Bluetooth radio.

9. The light engine installation kit of claim 1, further comprising at least one reflector tab recess on at least one of the first end cap or the second end cap, wherein the at least one reflector tab recess receives a reflector tab from the light engine.

10. The light engine installation kit of claim 1, wherein the first mounting bracket further comprises a tether hole and wherein the second mounting bracket further comprises a receiver slot having a wide slot portion, a narrow slot portion, and at least one upwardly angled tab between the wide slot portion of the receiver slot and the narrow slot portion of the receiver slot.

11. The light engine installation kit of claim 10, wherein the tether bracket further comprises a tether bracket extension that extends from the second end cap to cover the receiver slot on the second mounting bracket.

12. A method for installing a light engine into a fixture housing, the method comprising:

installing a first mounting bracket and a second mounting bracket into the fixture housing;

displacing a wide tab portion of a retainer tab on a first end of the light engine through a wide slot portion of a receiver slot on the first mounting bracket;

passing the wide tab portion of the retainer tab over at least one upwardly angled tab and further displacing the retainer tab so that a narrow tab portion of the retainer tab enters a narrow slot portion of the receiver slot;

engaging a tether on a second end of the light engine to the second mounting bracket;

connecting the light engine to an incoming power source;

raising the second end of the light engine into the fixture housing; and securing the second end of the light engine into the fixture housing.

13. The method of claim 12, further comprising aligning the first end of the light engine in the fixture housing; and securing the first end of the light engine into the fixture housing.

14. The method of claim 13, wherein securing the second end of the light engine into the fixture housing and securing the first end of the light engine into the fixture housing comprises installing fasteners.

15. The method of claim 12, further comprising modifying the first mounting bracket or the second mounting bracket to fit the fixture housing.

16. A sealed light engine comprising:

a lens comprising opposing side edges and comprising at least one flange and at least one ridge extending along the opposing side edges;

a reflector;

a wireway cover comprising opposing side edges; and at least one end cap comprising an inner surface and an outer surface opposite the inner surface, the inner surface defining at least one recess, wherein a first portion of the at least one recess is complementary in shape to a cross section of the lens and a second portion of the at least one recess is complementary in shape to a cross section of the reflector, wherein an end of the lens and an end of the reflector are more proximate to the inner surface than the outer surface of the at least one end cap when respectively seated in the first and second portions of the at least one recess, and wherein the at least one flange on each opposing side edge of the lens extends above one of the opposing side edges of the wireway cover and the at least one ridge on each opposing side edge of the lens is adjacent one of the opposing side edges of the wireway cover.

17. The sealed light engine of claim 16, further comprising a reflector extension, wherein the reflector extension engages the second portion of the at least one recess of the at least one end cap.

18. The sealed light engine of claim 16, further comprising a sealing element in the at least one recess of the at least one end cap selected from the group consisting of rubber, gasket material, and foam.

19. The sealed light engine of claim 16, wherein the at least one recess is configured to straighten or reform the reflector or the lens during installation of the at least one end cap.

* * * * *